United States Patent [19]

Tauber et al.

[11] Patent Number: 4,499,527

[45] Date of Patent: Feb. 12, 1985

[54] AIRPORT RUNWAY/TAXIWAY EDGE LIGHT FIXTURE

[75] Inventors: Richard J. Tauber, Simsbury; Daniel J. Rosborg, Bristol, both of Conn.

[73] Assignee: Cooper Industries, Inc., Houston, Tex.

[21] Appl. No.: 498,637

[22] Filed: May 27, 1983

[51] Int. Cl.[3] ..... F21V 29/00

[52] U.S. Cl. ..... 362/267; 362/153; 362/282; 362/311; 362/363; 362/368; 362/390; 362/418; 362/430; 362/431

[58] Field of Search ..... 340/26, 28, 114 R, 114 B; 362/153, 267, 282, 283, 311, 363, 368, 390, 410, 414, 418, 430, 431

[56] References Cited

U.S. PATENT DOCUMENTS

| | | | |
|---|---|---|---|
| 2,764,670 | 9/1956 | Van Dusen | 362/431 |
| 2,773,171 | 12/1956 | Pennow | 362/431 |
| 3,501,627 | 3/1970 | Macemon | 362/153 |
| 4,064,432 | 12/1977 | Compton | 362/431 |
| 4,074,941 | 2/1978 | Jablonski | 362/431 |
| 4,104,711 | 8/1978 | Carter | 362/153 |
| 4,175,282 | 11/1979 | Grindle | 362/363 |

FOREIGN PATENT DOCUMENTS

| | | | |
|---|---|---|---|
| 1091668 | 10/1960 | Fed. Rep. of Germany | 362/431 |
| 974353 | 11/1960 | Fed. Rep. of Germany | 362/431 |

OTHER PUBLICATIONS

"Aviation Lighting Systems", Crouse-Hinds Company Catalog, 1981.

*Primary Examiner*—Donald P. Walsh
*Attorney, Agent, or Firm*—Finnegan, Henderson, Farabow, Garrett & Dunner

[57] ABSTRACT

The present invention relates to an airport light fixture, and more particularly to an improved light fixture which finds particular utility as a runway or taxiway elevated edge light.

28 Claims, 5 Drawing Figures

30
21
20
10
28
29
29
22
23
27
25
25
24
65
27
26
26'
26
58
24
66
80
66
31
31
56
50
51
52
81
54
55
53
57
41
40
40
83
82
53A
55A
54A
56A
57A
52A 71
70
58

AIRPORT RUNWAY/TAXIWAY EDGE LIGHT FIXTURE

BACKGROUND OF THE INVENTION

To provide markers for airport runways and taxiways, it has become customary to employ light fixtures along the edges of runways and taxiways to facilitate guidance of aircraft during take-off, landing and taxiing operations. Conventional runway and taxiway elevated edge light fixtures typically consist of an upright support member or pedestal with a lamp assembly and prismatic globe mounted at its upper end. The support member is threadably or otherwise evgageable at its lower end with a base plate permanently mounted in or adjacent to the runway or taxiway. The globe provides a protective cover for the lamp assembly and can be optically configured as a lens to transmit light in a predetermined direction.

Such airport light fixtures are subjected to severe vibrations and high wind velocity, especially during aircraft operations. To preserve the desired directional alignment of these light fixtures, it is imperative that such fixtures be able to withstand such vibrations adn wind velocity without becoming tilted, misaligned or otherwise out of adjustment. However, for convenience and efficiency in the initial installation of such light fixtures and the subsequent correction of any misalignment which may occur, such fixtures should be readily adjustable externally while in place and without disassembly. To provide increased flexibility in leveling, such fixtures should be adjustably tiltable to plus or minus 7 degrees from horizontal at any point on a 360 degree horizontal plane. Moreover, such light fixtures should be provided with an optical globe which is firmly secured but conveniently removable for facilitating repair and/or replacement of the lamp, the lamp assembly, and the globe, as necessary.

As mentioned, precise angular orientation of the globe, i.e. position accuracy, is essential in such airport light fixtures. This is particularly so in bidirectional applications, in which horizontal aiming is critical. Convenience and efficiency in installation, repair and replacement of the globe may, thus, not be achieved at any sacrifice to position accuracy.

In order to provide the precise light pattern required, it is important that the lamp assembly of the light fixture be accurately and rigidly located. In the airport light fixture disclosed, for example, in U.S. Pat. No. 4,104,711, such precise location of the lamp assembly is achieved by mounting the electric lamp in an electrical socket which is supported by a mounting bracket which, in turn, is rigidly secured to the lamp base. Typically, such electrical sockets are secured by conventional nut and bolt type assembly hardware which is time-consuming to assemble and/or disassemble.

An additional problem arises from the fact that the design of electrical socket mounting brackets in conventional airport light fixtures has not adequately taken into account the applicable thermal considerations, and in particular, the need to minimize heat absorption by the bracket and heat transfer to the bracket.

An airport light fixture for mounting on a substantially cylindrical support column, comprising a lamp structure for providing illumination; an optical globe for covering the lamp and for directing the light emanating therefrom; and a base member for securely mounting the globe and the lamp structure in an adjustable, substantially upright position on the support column, the globe being releasably securable to the base member and substantially sealed over the lamp structure for protecting the lamp structure, the base member including, at its bottom, a mounting hub for mounting the base member on the upper end of the support column, the mounting hub including: (a) a substantially annular planar support surface positioned on the upper end of the support column when the base member is mounted thereon; (b) a substantially cylindrical collar depending downwardly from the planar support surface and having a plurality of leveling screws extending transversely therethrough for contacting the peripheral surface of the support column when the base member is mounted thereon for adjusting the tilt of the base member, as necessary, to obtain and securely maintain the desired vertical positioning of the globe; and (c) a plurality of guide ribs depending downwardly from the planar support surface and interiorly of the collar, the guide ribs being spaced around the support surface, and the interior surface of each of the ribs facing the support column when the base member is mounted thereon being equivalently tapered such that an imaginary surface passing through each of the individual surfaces is frustro-conically shaped and has its smaller diameter end adjacent the planar support surface, the smaller diameter being substantially equal to the outer diameter of the upper end of the support column for guiding the planar support surface of the mounting hub to the desired position above such upper end during mounting of the base member on the support column; the taper and positioning of each of the guide ribs, and the positioning of the collar and the leveling screws, being selected to permit adjustment of the tilt of the support member at any point on the circumference of the support column, as necessary to obtain the desired vertical positioning of the globe.

Additionally, a lamp socket mounting bracket comprising a pair of rigid, substantially upright, spaced apart support legs, each of the legs being secured at its bottom to the top portion of the base member in substantially parallel relationship at opposite sides thereof, each of the legs having at least two substantially upright stops projecting laterally therefrom in parallel relationship, the upper ends of each pair of stops being adjoined by a cross piece which forms a shelf for supporting the socket, the mounting bracket further having two, parallel, spaced apart retainer flanges connecting the upper ends of the legs and extending substantially orthogonally thereto for contacting the upper surface and the respective side surfaces of the socket when the socket is supported on the shelves for substantially preventing upward and lateral movement of the socket, respectively, each of the stops on one of the legs having an elongated surface inclined inwardly from the bottom, and the stops on the other of the legs each having similarly inclined elongated surfaces, the legs and the stops being situated such that, during upward insertion of the socket into the mounting bracket from below, the socket operatively engages the inclined surface of each of the stops, causing the legs to flex outwardly away from one another for permitting the socket to pass upwardly along and then beyond the inclined surfaces, the legs, the retainer flanges, and the junction therebetween being adapted to permit the legs to resiliently return to substantially their original positions, with the socket then resting on the shelves.

Also, a base member for mounting a globe and lamp assembly of an airport light fixture on a support column, including at least one resilient finger-like member having its free end normally extending upwardly a preselected distance above the globe support surface for engaging at least one of the globe tongues to deter or retard rotation of the globe on the base member in a rotational direction opposite to the one direction, the free end being displacable towards the globe support surface when the finger-like member is resiliently flexed downwardly for permitting desired rotation of the globe in such opposite direction.

SUMMARY OF THE INVENTION

The present invention, as embodied and broadly described herein, overcomes the above-noted problems and disadvantages of the prior art and achieves the objectives outlined above by providing an airport light fixture for mounting on a substantially cylindrical support column, comprising lamp means for providing illumination; an optical globe for covering the lamp means and for directing the light emanating therefrom; and a base member for securely mounting the globe and the lamp means in an adjustable, substantially upright position on the support column, the globe being releasably securable to the base member and substantially sealed over the lamp means for protecting the lamp means, the base member including, at its bottom, a mounting hub for mounting the base member on the upper end of the support column, the mounting hub including: (a) a substantially annular planar support surface positioned on the upper end of the support column when the base member is mounted thereon; (b) substantially cylindrical collar means depending downwardly from the planar support surface and having a plurality of leveling screws extending transversely therethrough for contacting the peripheral surface of the support column when the base member is mounted thereon for adjusting the tilt of the base member, as necessary, to obtain and securely maintain the desired vertical positioning of the globe; and (c) a plurality of guide ribs depending downwardly from the planar support surface and interiorly of the collar means, the guide ribs being spaced around the support surface, and the interior surface of each of the ribs facing the support column when the base member is mounted thereon being equivalently tapered such that an imaginary surface passing through each of the individual surfaces is frustro-conically shaped and has its smaller diameter end adjacent the planar support surface, the smaller diameter being substantially equal to the outer diameter of the upper end of the support column for guiding the planar support surface of the mounting hub to the desired position above such upper end during mounting of the base member on the support column; the taper and positioning of each of the guide ribs, and the positioning of the collar means and the leveling screws, being selected to permit adjustment of the tilt of the support member at any point on the circumference of the support column, as necessary, to obtain the desired vertical positioning of the globe. Typically, at least three leveling screws are provided, the screws being spaced around the support column, and at least three, and preferably six, guide ribs are provided, the ribs also being spaced around the support column.

As broadly embodied herein, the present invention further comprises a mounting bracket for mounting a lamp socket and a lamp received therein on a base member of an airport light fixture, the bracket comprising a pair of rigid, substantially upright, spaced apart support legs, each of the legs being secured at its bottom to the top portion of the base member in substantially parallel relationship at opposite sides thereof, each of the legs having at least two substantially upright stops projecting laterally therefrom in parallel relationship, the upper ends of each pair of stops being adjoined by a cross piece which forms a shelf for supporting the socket, the mounting bracket further having two, parallel, spaced apart retainer flanges connecting the upper ends of the legs and extending substantially orthogonally thereto for contacting the upper surface and the respective side surfaces of the socket when the socket is supported on the shelves for substantially preventing upward and lateral movement of the socket, respectively, each of the stops on one of the legs having an elongated surface inclined inwardly from the bottom, and the stops on the other of the legs each having similarly inclined elongated surfaces, the legs and the stops being situated such that, during upward insertion of the socket into the mounting bracket from below, the socket operatively engages the inclined surface of each of the stops, causing the legs to flex outwardly away from one another for permitting the socket to pass upwardly along and then beyond the inclined surfaces, the legs, the retainer flanges, and the junction therebetween being adapted to permit the legs to resiliently return to substantially their original positions, with the socket then resting on the shelves. The legs are typically spaced from the outer periphery of the socket by spacer ridges situated on the inner surface of each leg.

Broadly, the invention also comprises a base member for mounting a globe and lamp assembly of an airport light fixture on a support column, comprising a mounting hub for mounting the base member on the support column; a generally circular globe support surface having a plurality of peripherally spaced flanges providing inwardly facing channels, the globe having a generally circular base provided with a plurality of peripherally spaced outwardly projecting tongues for rotatable assembly into the channels to secure the globe to the base member, at least one of the flanges having a projection for engaging at least one of the tongues to limit rotation of the globe on the base member in one direction; and at least one resilient finger-like member having its free end normally extending upwardly a preselected distance above the globe support surface for engaging at least one of the globe tongues to deter or retard rotation of the globe on the base member in a rotational direction opposite to the one direction, the free end being displacable towards the globe support surface when the finger-like member is resiliently flexed downwardly for permitting desired rotation of the globe in such opposite direction.

Additional objects and advantages of the invention will be set forth in part in the description which follows, and in part will be obvious from the description, or may be learned by practice of the invention. The objects and advantages of the invention will be realized and attained by means of the instrumentalities and combinations particularly pointed out in the appended claims.

It is to be understood that both the foregoing general description and the following detailed description are exemplary and explanatory only, and are not intended to be restrictive of the invention as claimed.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the presently preferred embodiment of the invention, an example of which is illustrated in the accompanying drawings.

Figures 1, 4, 5:
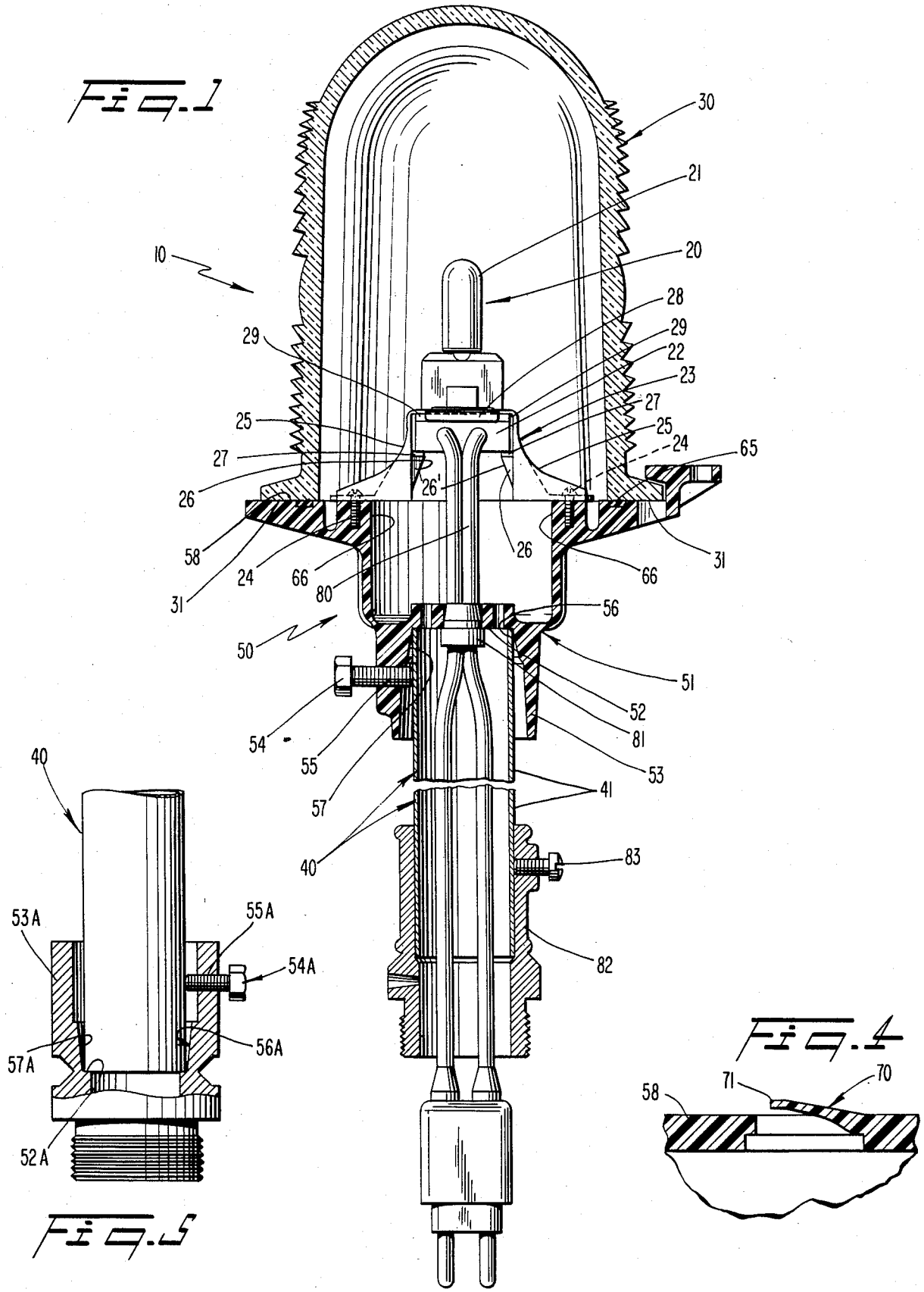
FIG. 1 is a diagrammatic vertical section view of an airport light fixture constructed in accordance with the present invention.
FIG. 4 is a partial cross-sectional view of the airport light fixture base member of the present invention taken along line 4—4 of FIG. 2, showing the resilient finger-like member for providing retention of the light fixture globe on the base member.
FIG. 5 is a diagrammatic partial vertical section view of an airport light fixture support column and a coupling therefor constructed in accordance with a further embodiment of the invention.

The presently preferred embodiment of the airport runway/taxiway elevated edge light fixture of the present invention is shown in FIG. 1, and is represented generally by the numeral 10. This fixture includes lamp means 20; a prismatic globe 30 for covering the lamp means and for directing the light emanating therefrom in the desired direction; a substantially cylindrical support column 40; and a base member 50 (globe support) for securely mounting globe 30 and lamp means 20 in an adjustable, substantially upright position on support column 40. Base member 50 includes, at its bottom, a mounting hub 51 for mounting the base member on the upper end of support column 40.

Figure 2:
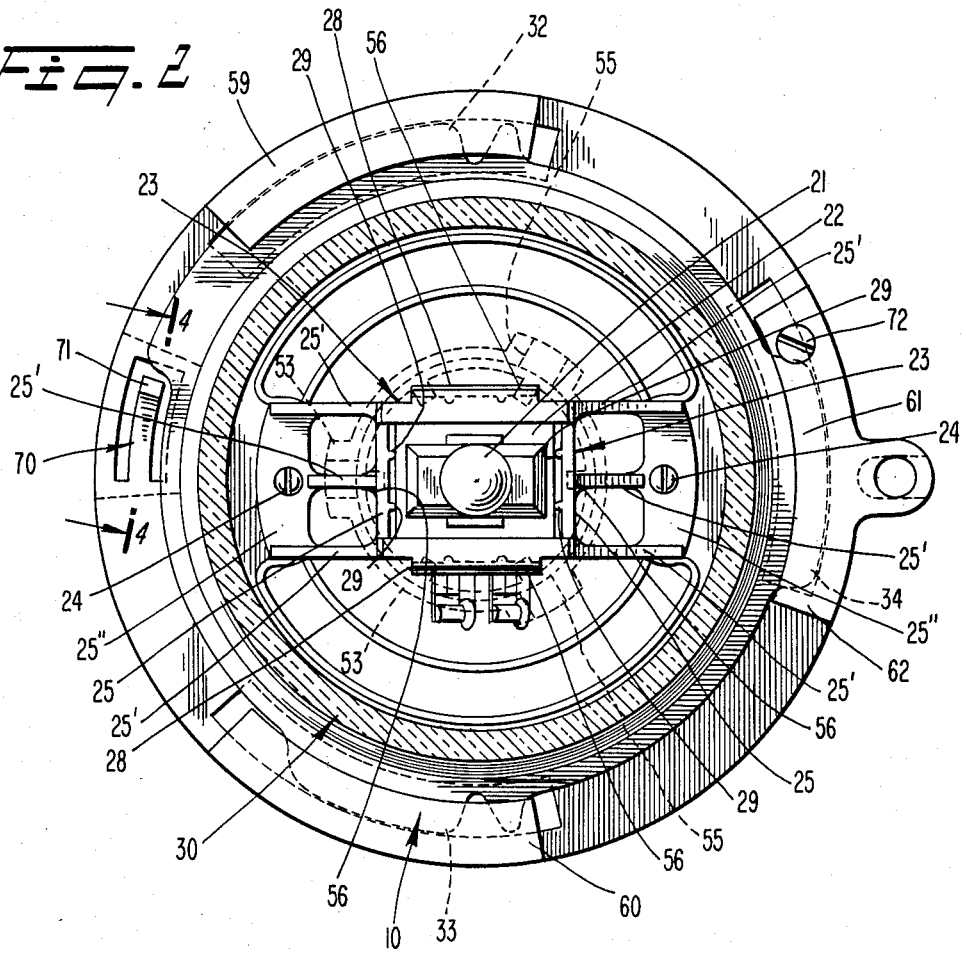
FIG. 2 is a plan view of the embodiment shown in FIG. 1 in partial cut-away form to reveal details of its construction.
Figure 3:
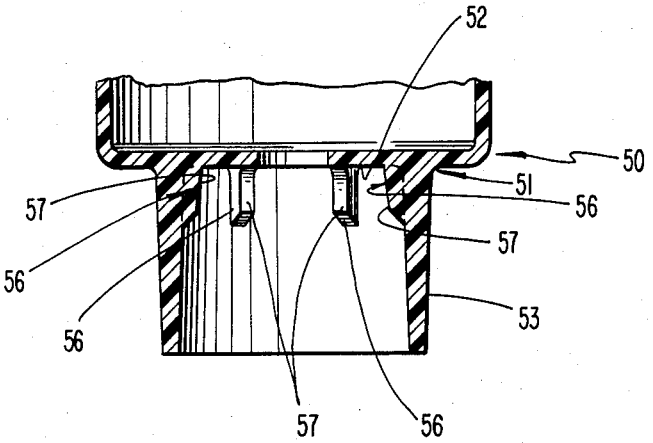
FIG. 3 is a partial diagrammatic vertical section view of the airport light fixture base member of the present invention showing the details of construction of the mounting hub.

Referring to FIGS. 1–3, mounting hub 51 includes a generally planar support surface 52 which extends annularly and rests on the upper end 41 of support column 40 when base member 50 is mounted on the support column. A generally cylindrical collar 53 extends downwardly from support surface 52 so as to surround the upper end 41 of support column 40. Typically, collar 53 is between 1 and 3 inches long, the outer diameter of upper end 41 is on the order of 1 inch, and the inner diameter of collar 53 is about $1\frac{1}{2}$ inches.

Leveling set screws 54 pass through holes 55 which extend transversely through collar 53. Preferably, at least three holes 55 are spaced equidistantly around collar 53, with a leveling screw 54 passing through each such hole. It is preferable, for strengthening purposes, to provide collar 53 with regions of increased thickness immediately surrounding holes 55, as shown. The inner ends of leveling screws 54 firmly contact the peripheral surface of support column 40 upon tightening the screws, so as to provide positive and rigid fastening of base member 50 to support column 40. The degree of tightening of each leveling screw 54 determines the horizontal tilt of base member 50. Thus, the tilt of base member 50 may be controlled at any point on the circumference of support column 40, as necessary, to obtain the desired leveling of base member 50 and attached globe 30.

In practice, base member 50 and attached globe 30 are leveled to the desired position through the use of a conventional leveling device, as well known in the art. The desired position is maintained by individually adjusting the degree of tightening of each of the three leveling screws 54 as necessary. As can be seen, leveling screws 54 are readily accessible externally for easy, rapid, and efficient adjustment.

A plurality of guide ribs 56 (flutes) depends downwardly from planar support surface 52 on the inner circumference of mounting hub 51. Guide ribs 56 are situated interiorly of collar 53 and typically are between about $\frac{1}{4}$ inch and about 2 inches long. Preferably, at least three, and more preferably, six guide ribs 56 are spaced around support surface 52. The interior surface 57 of each rib 56 is equivalently tapered (see FIGS. 1 and 3) such that an imaginary surface passing through each of said surfaces 57 is frustro-conically shaped, with its smaller diameter end adjacent support surface 52 when base member 50 is mounted on support column 40. Such smaller diameter is preferably substantially equal to the outer diameter of the upper end 41 of support column 40, and the interior surface of each rib 56 is preferably tapered from vertical at a slope of between about 5 degrees and about 10 degrees, and most preferably at about 8 degrees. As a result of the aforesaid construction of guide ribs 56, they serve to guide substantially planar support surface 52 of mounting hub 51 to the desired position above the upper end 41 of support column 40 during the mounting of base member 50 on the support column. That is, the six tapered guide ribs 56 on the inner circumference of mounting hub 51 provide, at their base portions adjoining planar support surface 52, the minimum clearance required to centrally locate support column 40 beneath base member 50. Preferably, the tapered surfaces and the positioning of guide ribs 56, as well as the arrangement of collar 53 and leveling screws 54, are selected to permit adjustment of the tilt of base member 50 to plus or minus 7 degrees from horizontal at any point on a 360 degree horizontal plane for leveling purposes, while still maintaining centering at the top of support column 40.

As an alternative to providing six separate tapered guide ribs 56, the mounting hub 51 may be constructed with a single tapered guide ring having an inner profile (surface) equivalent to the profile of interior surface 57, but extending the entire 360° of the inner circumference of mounting hub 51.

In the preferred embodiment of the invention, base member 50, including mounting hub 51, is of one-piece rigid non-metallic construction, preferably constructed of polymeric materials, or derivatives thereof, having suitable physical properties for the desired application and being moldable by injection or compression molding, or another appropriate molding process. Examples of such polymeric materials include, without limitation, thermosetting and thermoplastic resins and mixtures thereof, such as, for example, the following resins: polycarbonate, polyester, phenol, urea, furfural, allyl, epoxy, silicon, borosilicone, carbosilicone, and mixtures thereof, with one or more of the following reinforcing fillers: glass fibers, mica and asbestos.

Preferably, base member 50 is constructed of a material which will provide the following base member property characteristics (a) U.L. ® Temperature Index Rating of at least about 102° C.; (b) Izod Impact Strength (notched) of at least about 2.0 ft. lb./in.; (c) Tensile Strength of about 23,000 psi; (d) Flexural Strength of about 37,000 psi; and (e) Compressive Strength of about 25,000 psi.

Referring to FIGS. 1 and 2, base member 50 is typically circular, when viewed from above, and globe 30 typically includes a circular base portion having a flat surface 31 for mating with a corresponding flat upper surface 58 of base member 50. As shown in FIG. 1, a static seal 65 of round, square or other cross section is preferably provided between such mating surfaces 31 and 58 for providing a fluid-tight seal to protect lamp means 20 against dust, wind, rain and other weather-related damage.

As shown in FIG. 1, globe 30 is preferably dome-shaped in configuration. It can be made of transparent, colored material such as, for example, glass or polymeric material, so as to emit only light of the desired color. The surface of globe 30 is preferably configured so as to provide the desired optical properties, e.g., distributing light in particular directions. As shown in FIG. 2, globe 30 preferably includes three outwardly projecting tongues 32, 33, 34 at its base portion. One of the tongues, e.g., tongue 32, is preferably substantially wider than the others to facilitate the desired orientation of globe 30 on base member 50.

Referring to FIGS. 1 and 2, base member 50 preferably includes three upstanding flanges 59, 60, 61 spaced about the periphery of its generally circular top surface 58. The flanges are elongated and extend tangentially along the periphery of the base member. In addition, flanges 59, 60, 61 have radially inward facing channels for receiving tongues 32, 33, 34, respectively, of globe 30. In the assembly of globe 30 to base member 50, the globe is placed on the top surface 58 of the base member with its tongues 32, 33, 34 located in the spaces between flanges 59, 60, 61, respectively, and globe 30 is then rotated in a clockwise direction, as viewed in FIG. 2, to move tongues 32, 33, 34 into the corresponding channels defined by flanges 59, 60, 61, respectively. Preferably, a stop is provided on at least one of the flanges 59, 60, 61 to limit rotational movement of at least one of the tongues in its channel. As shown in FIG. 2, flange 61 may, for example, include a stop 62 extending radially inward to block clockwise movement of tongue 34 beyond flange 61.

As broadly embodied herein, the present invention further comprises a light fixture base member 50 having at least one vertically resilient finger-like member 70 (see FIGS. 2 and 4) having a free end 71 normally extending above base member top surface 58. When tongues 32, 33, 34 are located in the corresponding channels defined by flanges 59, 60, 61, respectively, the free end 71 is situated such that tongue 32 is deterred or retarded from rotating counter-clockwise, thus deterring or retarding rotation of globe 30 in the counter-clockwise direction.

Removal of globe 30 from base member 50 is readily accomplished by manually applying a downward force to finger-like member 70 to lower it a sufficient distance to permit counterclockwise rotation of the globe to a point where tongues 32, 33, 34 are disengaged from flanges 59, 60, 61, so that the globe may be lifted off base member 50. Alternatively, base member 50, finger-like member 70, and globe 30 may be designed such that counter-clockwise rotation of the globe will cause a force to be transmitted through the globe to displace the finger-like member downwardly to permit removal of the globe.

Globe 30 is mounted on base member 50 by placing the globe on the base member top surface 58, as described above, and applying a downward force to finger-like member 70 to depress it to substantially the same level as top surface 58 by simply exerting downward pressure on globe 30 and then rotating the globe clockwise as previously discussed. At the point when globe tongue 32 rotates clockwise sufficiently to disengage from above the free end 71 of finger-like member 70, the free end will resiliently return to nearly its original position so as to interpose the edge of the globe tongue.

The above-described retarding mechanism permits precise angular orientation and facilitates removal and replacement of globe 30, while maintaining sufficient position accuracy. This is important in bidirectional applications in which horizontal aiming is required.

Preferably, finger-like member 70 is integral with the remainder of base member 50, with both being of one-piece resilient non-metallic construction.

As an alternative to the aforementioned globe snap lock feature, proper location of globe 30 on base member 50 may be optionally maintained by assembling a retaining screw 72 vertically into a hole provided on the side of base member flange 61 opposite stop 62 (or in an equivalent side of flanges 59 or 60) after globe 30 has been fully rotated to the desired installed position. Similarly to finger-like member 70, screw 72 precludes counter-clockwise rotation of globe 30 by blocking the path through which the globe tongue must travel, thereby assuring proper positioning of the globe.

As embodied herein, and referring to FIGS. 1 and 2, the lamp means 20 includes an electrical lamp 21 provided with prongs (not shown) and an electrical socket 22 for receiving the prongs. Socket 22 is securely mounted on a mounting bracket 23 secured by two self-tapping binding screws 24 at its opposite ends to mounting bracket supports 66 formed on the top portion of base member 50. Mounting bracket supports 66 are situated inside globe support surface 58. A pair of electrical leads 80 extends downwardly from socket 22 through a grommet 81 provided in a central opening in the annular mounting hub support surface 52 of base member 50. The leads 80 extend further downwardly through the hollow interiors of support column 40 and a suitable conventional coupling 82. As shown in FIG. 1, coupling 82 preferably comprises a tubular frangible coupling which serves to securely support support column 40 by means of a securing screw 83 and to facilitate connection of leads 80 to an external power line (not shown). The light fixture is installed by connecting the bottom end of connector 82 to a base plate, a mounting stake, or the like, in the conventional manner. Preferably, coupling 82 and support column 40 are constructed of either metal or a nonmetallic material suitable for this application.

As embodied herein, mounting bracket 23 of the present invention includes a pair of rigid, substantially upright and parallel, spaced apart legs 25. Each of the legs 25 is provided with at least two substantially upright stops 26 projecting laterally therefrom in substantially parallel relationship. The upper ends of each pair of stops 26 are adjoined by a cross piece 27 which forms a shelf 27 for supporting socket 22.

Mounting bracket 23 further includes two parallel, spaced apart retainer flanges 28 connecting the upper ends of legs 25 and extending substantially orthogonally thereto for contacting the upper surface and the respective side surfaces of socket 22 when the socket is supported on shelves 27 for substantially preventing upward and lateral movement of socket 22, respectively. Retainer flanges 28 preferably have a right angle contour (FIGS. 1 and 2) to complementarily overlap the sides of socket 22. The socket is preferably rectangular in form, when viewed from its sides.

Each of said stops 26 has an elongated surface 26' inclined inwardly from the bottom. In accordance with the invention, stops 26 and legs 25 are situated such that, during the upward insertion of socket 22 into mounting bracket 23 from below, socket 22 operatively engages the inclined surface 26' of each stop 26, which causes legs 25 to flex outwardly away from one another for permitting socket 22 to pass upwardly along and then beyond inclined surfaces 26'. Legs 23, retainer flanges 28 and the junction therebetween are constructed so as to permit legs 23 to resiliently return to their original positions, with socket 22 then resting on shelves 27. This is accomplished, for example, by constructing bracket member 23 as a rigid, one piece nonmetallic structure, using, for example, polymeric materials, or derivatives thereof, with one or more reinforcing fillers. The bracket member 23 is preferably injection molded, compression molded, extruded, pressed, or formed through a sequence of these processes to a thickness within the range of from about 0.02 to about 0.09 inch, more preferably on the order of about 0.06 inch thick.

Preferably, bracket member 23 is constructed of a material which will provide the following bracket member property characteristics: (a) U.L. ® Temperature Index Rating of at least about 150° C.; (b) Izod Impact Strength (notched) of at least about 1.4 ft. lb./in.; (c) Tensile Strength of about 19,000 psi; (d) Flexural Strength of about 26,800 psi; and (e) Compressive Strength of about 21,000 psi.

Preferably, the surface of each leg 25 and each retainer flange 28 which faces socket 22 includes at least one inwardly projecting, elongated ridge 29 for contacting socket 22 when it is mounted on mounting bracket 23. Ridge 29, by providing substantially point contact with socket 22, serves to position socket 22 on mounting bracket 23, while also facilitating ventilation around the socket and the bracket to aid in cooling them. Moreover, each leg 25 preferably includes at least two ribs 25' extending outwardly from its base and terminating in an integral tongue portion 25'' for securing mounting bracket 23 on opposite sides of the top portion of base member 50.

The lamp socket mounting bracket 23 of the present invention, as described above, thus incorporates a resilient socket mounting feature that eliminates conventional nut and bolt type assembly hardware and facilitates assembly of the light fixture, as well as providing precise location of the parts involved. The mounting bracket provides both a minimum amount of horizontal cross-sectional surface area exposed to the radiant lumens emanating from the lamp for minimum heat absorption and point contact location of the socket for minimizing conductive heat transfer, thus maximizing its cooling properties. Furthermore, the design and assembly geometry assure accurate and rigid location of the lamp socket, as required to provide the precise light pattern necessary in airport light fixtures.

It will be apparent to those skilled in the art that various modifications and variations can be made in the airport light fixture of the present invention without departing from the scope or spirit of the invention. For example, the above-described locating and leveling features of mounting hub 51 may optionally be substituted and incorporated into coupling 82A, rather than mounting hub 51, as shown in FIG. 5 (features analogous to those shown in FIG. 1 bear the same reference numerals plus the suffix "A"). In such an embodiment, the inside diameter of mounting hub 51 will be uniform and will be similar to that of coupling 82 of FIG. 1. Mounting hub 51 will then require only a single binding screw to secure the hub to the upper end of support column 40, while three leveling screws 54A will be required on coupling 82A.

Thus, it is intended that the present invention cover such modifications and variations of this invention, provided they come within the scope of the appended claims and their equivalents.

We claim:

1. An airport light fixture for mounting on a substantially cylindrical support column, comprising:

lamp means for providing illumination;

an optical globe for covering said lamp means and for directing the light emanating therefrom; and a base member for securely mounting said globe and said lamp means in an adjustable, substantially upright position on said support column, said globe being releasably securable to said base member and substantially sealed over said lamp means for protecting said lamp means, said base member including, at its bottom, a mounting hub for mounting said base member on the upper end of said support column, said mounting hub including:

(a) a substantially annular planar support surface positioned on said upper end of said support column when said base member is mounted thereon;

(b) substantially cylindrical collar means depending downwardly from said planar support surface and having a plurality of leveling screws extending transversely therethrough for contacting the peripheral surface of said support column when said base member is mounted thereon for adjusting the tilt of said base member, as necessary, to obtain and securely maintain the desired vertical positioning of said globe; and (c) a plurality of guide ribs depending downwardly from said planar support surface and situated interiorly of said collar means, said guide ribs being spaced around said support surface, the interior surface of each of said ribs facing said support column when said base member is mounted thereon being equivalently tapered such that an imaginary surface passing through each of said individual surfaces is frusto-conically shaped, having its smaller diameter end adjacent said planar support surface, said smaller diameter being substantially equal to the outer diameter of said upper end of said support column for guiding said planar support surface of said mounting hub to the desired position above said upper end during mounting of said base member on said support column, the taper and positioning of each of said guide ribs, and the positioning of said collar means and said leveling screws, being selected to permit adjustment of the tilt of said support member at any point on the circumference of said support column, as necessary, to obtain said desired vertical positioning of said globe.

2. An airport light fixture as claimed in claim 1, wherein at least three of said leveling screws are provided, said screws being spaced around said support column.

3. An airport light fixture as claimed in claim 1, wherein at least three of said guide ribs are provided in spaced relation around said support column.

4. An airport light fixture as claimed in claim 1, wherein at least six of said guide ribs are provided in spaced relation around said support column.

5. An airport light fixture for mounting on a substantially cylindrical support column, comprising:

lamp means for providing illumination;

an optical globe for covering said lamp means and for directing the light emanating therefrom; and a base member for securely mounting said globe and said lamp means in an adjustable, substantially upright position on said support column, said globe being releasably securable to said base member and substantially sealed over said lamp means for protecting said lamp means, said base member including, at its bottom, a mounting hub for mounting said base member on the upper end of said support column, said mounting hub including:

(a) a substantially annular planar support surface positioned on said upper end of said support column when said base member is mounted thereon;

(b) substantially cylindrical collar means depending downwardly from said planar support surface and having a plurality of leveling screws extending transversely therethrough for contacting the peripheral surface of said support column when said base member is mounted thereon for adjusting the tilt of said base member, as necessary, to obtain and securely maintain the desired vertical positioning of said globe; and (c) a tapered guide ring depending downwardly from said planar support surface and situated interiorly of said collar means, the interior surface of said guide ring facing said support column when said base member is mounted thereon being frusto-conically tapered, having its smaller diameter end adjacent said planar support surface, said smaller diameter being substantially equal to the outer diameter of said upper end of said support column for guiding said planar support surface of said mounting hub to the desired position above said upper end during mounting of said base member on said support column, the taper and positioning of said guide ring, and the positioning of said collar means and said leveling screws, being selected to permit adjustment of the tilt of said support member at any point on the circumference of said support column, as necessary, to obtain said desired vertical positioning of said globe.

6. An airport light fixture as claimed in claim 1, wherein said base member is substantially circular, when viewed from above, and said globe includes a substantially circular base portion having a flat surface for mating with said base member.

7. An airport light fixture as claimed in claim 6, wherein a static seal is provided between the mating surfaces of said globe base portion and said base member.

8. An airport light fixture as claimed in claim 1 wherein said base member is of one-piece polymeric material construction and possesses U.L. temperature index rating of at least about 102° C.

9. An airport light fixture as claimed in claim 1 wherein said base member is of one-piece polymeric material construction and possesses an Izod impact strength, notched, of at least about 2.0 ft. lb./inch.

10. An airport light fixture as claimed in claim 1 wherein said base member is of one-piece polymeric material construction and possesses a tensile strength of about 23,000 psi, a flexural strength of about 37,000 psi, and a compressive strength of about 25,000 psi.

11. An airport light fixture as claimed in claim 1, wherein the taper and positioning of each of said guide ribs are selected to permit adjustment of the tilt of said support member to plus or minus 7 degrees from horizontal at any point on the circumference of said support column.

12. An airport light fixture as claimed in claim 1, wherein said base member has a generally circular top surface having a plurality of peripherally spaced flanges providing inwardly facing channels, said globe having a generally circular base provided with a plurality of peripherally spaced outwardly projecting tongues for rotatable assembly into said channels to secure said globe to said base member.

13. An airport light fixture as claimed in claim 12, wherein at least one of said flanges has a projection for engaging at least one of said tongues to limit rotation of said globe on said base member in one direction, and wherein said base member has at least one resilient finger-like member having its free end normally extending upwardly a preselected distance above said top surface for engaging at least one of said tongues to deter rotation of said globe on said base member in a rotational direction opposite to said one direction, said free end being displacable beneath said top surface of said base member when said finger-like member is resiliently flexed downwardly for permitting desired rotation of said globe in said opposite direction.

14. An airport light fixture as claimed in claim 13, wherein said base member, including said finger-like member, is of one-piece polymeric material construction.

15. An airport light fixture as claimed in claim 1, wherein said lamp means includes:

(a) a lamp;

(b) a socket for operatively receiving said lamp; and (c) a mounting bracket for securely mounting said socket and lamp on said base member beneath said globe, said bracket having a pair of rigid, substantially upright, spaced apart legs, each of said legs being secured at its bottom to the top portion of said base member in substantially parallel relationship at opposite sides thereof, each of said legs having at least two substantially upright stops projecting laterally therefrom in parallel relationship, the upper ends of each pair of stops being adjoined by a cross piece which forms a shelf for supporting said socket, said mounting bracket further having two, parallel, spaced apart retainer flanges connecting the upper ends of said legs and extending substantially orthogonally thereto for contacting the upper surface and the respective side surfaces of said socket when said socket is supported on said shelves for substantially preventing upward and lateral movement of said socket, respectively, each of said stops on one of said legs having an elongated surface inclined inwardly from the bottom, and said stops on the other of said legs having similarly inclined elongated surfaces, said legs and said stops being situated such that, during upward insertion of said socket into said mounting bracket from below, said socket operatively engages the inclined surface of each of said stops, causing said legs to flex outwardly away from one another for permitting said socket to pass upwardly along and then beyond said inclined surfaces, said legs, said retainer flanges, and the junction therebetween being adapted to permit said legs to resiliently return to substantially their original positions, with said socket then resting on said shelves.

16. An airport light fixture as claimed in claim 15, wherein each of said legs includes a plurality of ribs extending outwardly from its base and terminating in an integral tongue portion for securing said mounting bracket on said base member.

17. An airport light fixture as claimed in claim 15, wherein said socket is substantially rectangular, when viewed from the side, and said retainer flanges have a right angle contour to complementarily overlap the sides of said socket.

18. An airport light fixture as claimed in claim 17, wherein the surface of each of said legs and each of said retainer flanges which faces said socket includes at least one inwardly projecting, spaced apart ridge for contacting said socket.

19. An airport light fixture as claimed in claim 15, wherein said socket and said mounting bracket are rectangular in shape, when viewed from above.

20. An airport light fixture as claimed in claim 15, wherein said mounting bracket is of one-piece polymeric material construction and possesses a U.L. temperature index rating of at least about 150° C.

21. An airport light fixture as claimed in claim 15, wherein said mounting bracket is of one-piece polymeric material construction and possesses an Izod impact strength, notched, of at least about 1.4 ft. lb./inch.

22. An airport light fixture as claimed in claim 15, wherein said mounting bracket is of one-piece polymeric material construction and possesses a tensile strength of about 19,000 psi, a flexural strength of about 26,800 psi, and a compressive strength of about 21,000 psi.

23. A mounting bracket for mounting a lamp socket and a lamp received therein on a base member of an airport light fixture, said bracket comprising a pair of rigid, substantially upright, spaced apart support legs, each of said legs being secured at its bottom to the top portion of the base member in substantially parallel relationship at opposite sides thereof, each of said legs having at least two substantially upright stops projecting laterally therefrom in parallel relationship, the upper ends of each pair of stops being adjoined by a cross piece which forms a shelf for supporting said socket, said mounting bracket further having two, parallel, spaced apart retainer flanges connecting the upper ends of said legs and extending substantially orthogonally thereto for contacting the upper surface and the respective side surfaces of said socket when said socket is supported on said shelves for substantially preventing upward and lateral movement of said socket, respectively, each of said stops on one of said legs having an elongated surface inclined inwardly from the bottom, and said stops on the other of said legs each having similarly inclined elongated surfaces, said legs and said stops being situated such that, during upward insertion of said socket into said mounting bracket from below, said socket operatively engages the inclined surface of each of said stops, causing said legs to flex outwardly away from one another for permitting said socket to pass upwardly along and then beyond said inclined surfaces, said legs, said retainer flanges, and the junction therebetween being adapted to permit said legs to resiliently return to substantially their original positions, with said socket then resting on said shelves, said legs being spaced from the outer periphery of said socket by at least one spacer ridge situated on the inner surface of each leg.

24. A base member for mounting a globe and lamp assembly of an airport light fixture on a support column, comprising:

(a) a mounting hub for mounting the base member on the support column;

(b) a generally circular globe support surface having a plurality of peripherally spaced flanges providing inwardly facing channels, the globe having a generally circular base provided with a plurality of peripherally spaced outwardly projecting tongues for rotatable assembly into said channels to secure the globe to the base member, at least one of said flanges having a projection for engaging at least one of said tongues to limit rotation of the globe on the base member in one direction; and (c) at least one resilient finger-like member having its free end normally extending upwardly a preselected distance above said globe support surface for engaging at least one of said tongues to deter rotation of the globe on the base member in a rotational direction opposite to said one direction, said free end being displacable beneath said globe support surface when said finger-like member is resiliently flexed downwardly for permitting desired rotation of the globe in said opposite direction.

25. A coupling for securely mounting a support column having an airport light fixture mounted thereon, comprising:

a base portion for securing the coupling in a fixed position; and a mounting hub integral with, and above, said base portion, said mounting hub including:

(a) a substantially annular support surface for supporting said support column when said support column is mounted thereon;

(b) substantially cylindrical collar means extending upwardly from said support surface and having a plurality of leveling screws extending transversely therethrough for contacting the peripheral surface of said support column when said support column is mounted on said support surface for adjusting the tilt of said support column, and thereby said light fixture, as necessary, to obtain and securely maintain the desired vertical positioning of said light fixture; and (c) a plurality of guide ribs extending upwardly from said support surface and situated interiorly of said collar means, said guide ribs being spaced around said support surface, the interior surface of each of said ribs facing said support column when said support column is mounted on said support surface being equivalently tapered such that an imaginary surface passing through each of said individual surfaces is frustoconically shaped, having its smaller diameter end adjacent said support surface, said smaller diameter being substantially equal to the outer diameter of said support column for guiding said support column to the desired position above said support surface during mounting of said support column on said support surface, the taper and positioning of each of said guide ribs, and the positioning of said collar means and said leveling screws, being selected to permit adjustment of the tilt of said support column, and thereby said light fixture, at any point on the circumference of said support column, as necessary, to obtain said desired vertical positioning of said light fixture.

26. An airport light fixture as claimed in claims 1, 5, 13 or 15, wherein said base member is of one-piece polymeric material construction.

27. A mounting bracket as claimed in claim 23, wherein the bracket is of one-piece polymeric material construction.

28. A base member as claimed in claim 24, wherein the base member is of one-piece polymeric material construction.

* * * * *

UNITED STATES PATENT AND TRADEMARK OFFICE

CERTIFICATE OF CORRECTION

PATENT NO. : 4,499,527

DATED : February 12, 1985

INVENTOR(S) : Richard J. Tauber and Daniel J. Rosborg

It is certified that error appears in the above-identified patent and that said Letters Patent is hereby corrected as shown below:

Column 11, line 65, line 1 of claim 8, after "claim 1", insert -- , 5 or 15 -- .

Column 12, line 1, line 1 of claim 9, after "claim 1", insert -- , 5 or 15 -- .

Column 12, line 5, line 1 of claim 10, after "claim 1", insert -- , 5 or 15 -- .

Signed and Sealed this

*Twenty-third* Day of *July 1985*

[SEAL]

*Attest:*

DONALD J. QUIGG

*Attesting Officer* *Acting Commissioner of Patents and Trademarks*